US010040187B2

(12) United States Patent
Hess et al.

(10) Patent No.: US 10,040,187 B2
(45) Date of Patent: Aug. 7, 2018

(54) HAND-HELD MACHINE TOOL WITH OUTER HOUSING

(71) Applicant: C. & E. FEIN GMBH, Schwäbisch Gmünd-Bargau (DE)

(72) Inventors: Achim Hess, Korb (DE); Uwe Früh, Sonnenbühl (DE); Jürgen Blickle, Göppingen (DE); Fabian Bek, Bobingen (DE)

(73) Assignee: C. & E. FEIN GMBH, Schwäbisch Gmünd-Bargau (DE)

( * ) Notice: Subject to any disclaimer, the term of this patent is extended or adjusted under 35 U.S.C. 154(b) by 561 days.

(21) Appl. No.: 14/380,253

(22) PCT Filed: Apr. 22, 2013

(86) PCT No.: PCT/EP2013/001204
§ 371 (c)(1),
(2) Date: Aug. 21, 2014

(87) PCT Pub. No.: WO2013/159901
PCT Pub. Date: Oct. 31, 2013

(65) Prior Publication Data

US 2015/0034347 A1 Feb. 5, 2015

(30) Foreign Application Priority Data

Apr. 24, 2012 (DE) ..... 10 2012 103 587

(51) Int. Cl.
*B25D 17/00* (2006.01)
*B25F 5/02* (2006.01)
(Continued)

(52) U.S. Cl.
CPC ..... *B25F 5/02* (2013.01); *B24B 23/04* (2013.01); *B24B 41/007* (2013.01); *B25F 5/006* (2013.01)

(58) Field of Classification Search
CPC ..... B25F 5/026; B25F 5/02; B25D 17/24
(Continued)

(56) References Cited

U.S. PATENT DOCUMENTS 3,637,029 A * 1/1972 Sherwood, Jr. ..... B27B 17/00 173/162.2
4,401,167 A * 8/1983 Sekizawa ..... B25D 17/043 173/162.1
(Continued)

FOREIGN PATENT DOCUMENTS

CN 201685237 U 12/2010
CN 101970183 A 2/2011
(Continued)

OTHER PUBLICATIONS

International Search Report for PCT/EP2013/001204.
(Continued)

*Primary Examiner* — Robert Long
(74) *Attorney, Agent, or Firm* — Benesch, Friedlander, Coplan & Aronoff LLP

(57) ABSTRACT

A handheld oscillation machine tool has support devices for maintaining a spacing between internal parts and an outer housing. The support devices are arranged in pairs of first and second support devices. One support device in each pair has a concave circular surface, and the other has an opposed convex circular surface. Elastically deformable damping elements are arranged between the pairs of support devices. The damping elements are deformed from original flat conditions under forces applied by the support devices, and have concave and convex circular surface adjoining the opposed concave and convex circular surfaces at the support devices.

15 Claims, 5 Drawing Sheets

Figure 1:
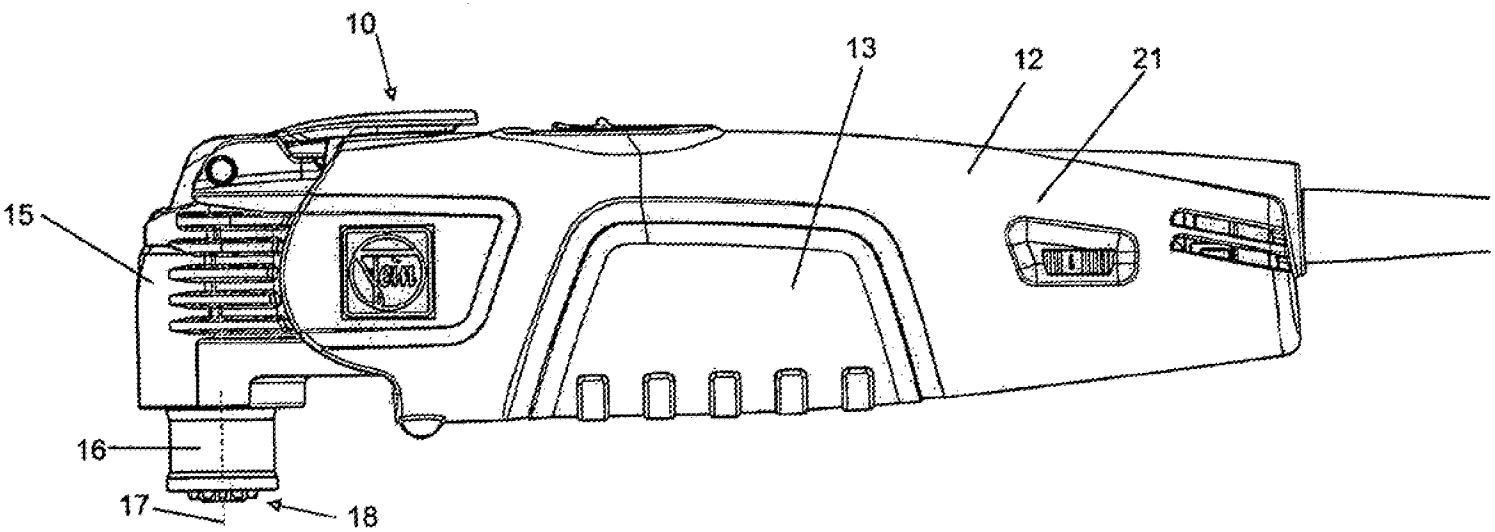

(51) Int. Cl.
*B25F 5/00* (2006.01)
*B24B 23/04* (2006.01)
*B24B 41/00* (2006.01)

(58) Field of Classification Search
USPC ..... 173/162.1–162.2, 210
See application file for complete search history.

(56) References Cited

U.S. PATENT DOCUMENTS 4,749,049 A * 6/1988 Greppmair ..... F16F 15/08 173/162.2
4,771,833 A * 9/1988 Honsa ..... B25D 17/043 16/431
4,936,394 A * 6/1990 Ohtsu ..... B24B 23/005 173/162.2
5,348,210 A * 9/1994 Linzell ..... B23K 20/129 228/115
5,522,466 A * 6/1996 Harada ..... B25F 5/006 173/162.2
5,692,306 A * 12/1997 Stoll ..... A01D 34/905 173/162.1
5,692,574 A * 12/1997 Terada ..... B25F 5/006 173/162.2
5,927,407 A * 7/1999 Gwinn ..... B25D 17/043 173/162.2
6,148,930 A * 11/2000 Berger ..... B25F 5/006 173/162.2
6,286,610 B1 * 9/2001 Berger ..... B25D 17/24 173/162.1
6,641,634 B2 * 11/2003 Reich ..... B23Q 11/0046 173/207
7,819,203 B2 * 10/2010 Sato ..... B25D 17/11 173/128
7,921,935 B2 * 4/2011 Engelfried ..... B25D 17/043 173/162.2
7,967,079 B2 * 6/2011 Stierle ..... B25F 5/006 173/162.2
8,038,133 B2 * 10/2011 McPherson ..... F16L 9/21 173/162.2
8,061,438 B2 * 11/2011 Schmid ..... B25D 17/043 173/162.2
8,590,633 B2 * 11/2013 Berghauser ..... B25D 17/06 173/109
8,714,280 B2 * 5/2014 Moreno ..... B25D 17/043 173/162.2
8,833,486 B2 * 9/2014 Krauter ..... B25F 5/006 173/162.1
8,966,773 B2 * 3/2015 Gregorich ..... B25F 5/006 173/162.2
9,168,652 B2 * 10/2015 Schadow ..... B25F 5/006
9,434,062 B2 * 9/2016 Kamegai ..... B25D 17/24
2005/0172678 A1 * 8/2005 Kim ..... A47B 91/005 68/3 R
2006/0086515 A1 * 4/2006 Engelfried ..... B25D 17/043 173/162.2
2006/0113098 A1 * 6/2006 Inagawa ..... B24B 23/028 173/162.2
2006/0125330 A1 * 6/2006 Winkler ..... H02K 5/24 310/51
2006/0289183 A1 * 12/2006 Schreiber ..... B25F 5/006 173/162.2
2007/0289762 A1 * 12/2007 Kikukchi ..... B25D 17/043 173/162.1
2007/0295521 A1 * 12/2007 Wiker ..... B24B 23/028 173/162.1
2008/0202784 A1 * 8/2008 Stierle ..... B25F 5/006 173/162.1
2008/0302552 A1 * 12/2008 Kondo ..... H01M 2/1066 173/217
2009/0194306 A1 * 8/2009 Johnson ..... B25F 5/006 173/162.1
2009/0266571 A1 * 10/2009 Baumann ..... B25D 17/24 173/162.2
2009/0294144 A1 * 12/2009 Frauhammer ..... B25D 17/043 173/162.2
2010/0012339 A1 * 1/2010 Hahn ..... B25F 5/006 173/162.2
2010/0067222 A1 * 3/2010 Yu ..... A45B 3/04 362/158
2010/0068977 A1 * 3/2010 Zhang ..... B25F 5/006 451/357
2010/0186979 A1 * 7/2010 Krauter ..... B25F 5/006 173/162.2
2010/0193209 A1 * 8/2010 Schadow ..... B24B 23/04 173/162.2
2010/0206596 A1 * 8/2010 Kamegai ..... B23D 51/01 173/162.2
2010/0258327 A1 * 10/2010 Esenwein ..... H01R 39/381 173/217
2011/0100665 A1 * 5/2011 Nakashima ..... B23D 51/01 173/162.2
2011/0120740 A1 * 5/2011 Moreno ..... B25D 17/043 173/162.2
2011/0313313 A1 * 12/2011 Levy ..... A61B 5/0051 600/552
2012/0031639 A1 * 2/2012 Roberts ..... B25D 17/043 173/162.2
2012/0067605 A1 * 3/2012 Furusawa ..... B25D 17/043 173/162.2
2012/0160533 A1 * 6/2012 Kamegai ..... B25D 17/24 173/162.2
2013/0255982 A1 * 10/2013 Takahashi ..... B25B 21/02 173/47
2015/0367495 A1 * 12/2015 Takeda ..... B25F 5/02 451/359
2016/0075007 A1 * 3/2016 Kutsuna ..... B25D 17/043 30/272.1
2016/0361809 A1 * 12/2016 Teranishi ..... B25D 17/043

FOREIGN PATENT DOCUMENTS

DE 3901728 A1 7/1990
DE 4000861 A1 7/1991
DE 4211316 A1 10/1993
DE 19730356 A1 1/1999
DE 10259518 A1 7/2004
DE 102005016453 A1 10/2006
DE 102009002969 A1 11/2010
JP WO 2010147153 A1 * 12/2010 ..... B25D 17/24

OTHER PUBLICATIONS

State Intellectual Property Office of China First Office Action dated Jun. 26, 2015.
Chinese Office Action for Chinese Application No. 201380021595.2 dated Jun. 26, 2015.
International Bureau's English translation of the international preliminary report on patentability (Chapter I) for PCT/EP2013/001204.

* cited by examiner

HAND-HELD MACHINE TOOL WITH OUTER HOUSING

The present invention concerns a handheld machine tool, particularly a handheld oscillation machine tool having an outer housing which extends essentially along the longitudinal axis and comprises a gripping region which is provided so that it can be gripped and the machine tool guided by a user's hand.

From the state-of-the-art, handheld machine tools are known, having housings that are either fixedly screwed to the drive units of the machine tool or consist of shell components, mostly half shells, which are fixedly connected to each other. In order to facilitate a good guiding of the handheld machine tools during processing of workpieces, the housings of machine tools known from the state-of-the-art lie against elements of the drive unit at least area wise, whereby structure borne sound, heat and vibrations of the drive units are transmitted to the housing simultaneously to a transmission of guiding forces from the user to the machine tool and of processing forces from the machine to the user, whereby work safety and comfort of handling of such a machine tool are affected.

The object of the invention is therefore to provide a handheld machine tool with an improved comfort of handling.

According to the invention, this object is reached by the teaching of the independent claim. Preferred embodiments of the invention are subject of the dependent claims.

A handheld machine tool according to the invention can particularly be a handheld oscillation machine tool. Such a handheld machine tool has an outer housing which extends essentially along the longitudinal axis and comprises a gripping region which is provided so that it can be gripped and the machine tool guided by a user's hand. An electric drive unit rotationally driving the drive shaft of machine tool is accommodated essentially within this outer housing. Thereby the axis of rotation of the drive shaft is essentially parallel to a longitudinal axis of the outer housing or can coincide with it.

A tool arrangement is essentially rigidly coupled to the electric drive unit, wherein the tool arrangement is arranged at an end region of the outer housing. The tool arrangement can thereby be arranged directly at a first and of the electric drive unit. It is also possible that the tool arrangement is arranged at a different arrangement, as for example a fan arrangement, which is preferably coupled essentially rigidly with the electric drive unit as well. In the context of the present invention, rigidly coupled means that these arrangements are coupled mechanically, whereby movements, also of the high frequent kind as for example vibrations can be transmitted from one to another element. A rigid connection can thereby also be formed through an integral design or similar in the sense of the present invention.

The outer housing of the handheld machine tool according to the invention comprises a defined inner contour. Accordingly, the electric drive unit and the tool arrangement essentially rigidly coupled thereto have a defined outer contour, wherein the tool arrangement has a defined outer contour at least as far as said outer contour is arranged in the region of the outer housing. In so far further arrangements, having outer contours extending between the electric drive unit and the tool arrangement, are arranged between the electric drive unit and the tool arrangement, these further arrangements constitute a part of the defined outer contour as well without respectively being explicitly mentioned in the following. The outer contour of these driving elements and the inner contour of the outer housing are formed such that they are at a predetermined minimum spacing from each other.

In order to observe this minimum spacing, a number N of first support devices at the outer contour of electric drive unit and to arrangement as well as a number N of second support devices at the inner contour of the outer housing is provided. The first support devices and the second support devices thereby cooperate in order to maintain the outer contour and the inner contour at this minimum spacing from one another.

By the cooperation of the first and the second support devices, the inner contour and thereby the outer housing and particularly the gripping region of the handheld machine tool is held at a distance of the outer contour and thereby in a distance from the electric drive unit and the tool arrangement. The transmission of structure borne sound, heat and vibrations from these drive elements essentially rigidly coupled to each other to the housing is thus reduced, whereby work safety and comfort of handling of the tool machine is considerably improved. The first and second support devices facilitate a sufficient transmission of support forces as the guiding forces from the user to the machine tool and the processing forces from the tool to the user.

The tool arrangement serves for transmission of the driving torque of the electric drive unit to a tool preferably arranged at the two arrangement. For transmission of the drive power of the electric drive unit to a tool, the two arrangement can comprise various elements as gearboxes, couplings and the like. Thus, as well the electric drive unit as the tool arrangement can be configured in several parts. Preferably, the machine tool comprises the tool holder at the end of the tool arrangement opposite to the electric drive unit, whereby the driving axis of the tool holder can also miter with respect to the drive axis of the electric drive element. Generally, the tool holder can be arranged at an outer end of the drive axis, it can however be arranged at a region from the end of the tool assembly. Exemplary, the tool holder can also be arranged in the tool arrangement within a recess in the region of the drive shaft, wherein the tool can be inserted into the recess. The tools usable with the machine tool particularly surf for cutting, grinding, sawing, grating or for further material chipping, removing or forming processing steps.

The defined outer contour of electric drive unit and tool assembly preferably results essentially from the shape of these driving elements, which is particularly influenced by their drive function and by requirements for an ergonomic machine tool design.

The defined inner contour of the outer housing preferably follows at least sectionally the defined outer contour of electric drive unit and—as far as the outer housing encloses the electric drive unit—the tool arrangement. Thereby the outer contour and the inner contour with the exception of the areas of the first and the second support devices are at a minimum spacing from one another. Thus, a direct transmission of structure borne sound, heat and vibrations, which particularly originate from the actuation of the tools and as a result of processing steps, from the outer contour to the inner contour and thereby to the outer housing is avoided. The predetermined minimum spacing is particularly within a range up to 5 mm, preferably it is between 1 mm and 3 mm and especially preferably approximately 2 mm. The predetermined minimum spacing and the air layer thereby lying between the outer contour and the inner contour—alongside a mechanical decoupling leads—to a further reduction of the heat transmitted from the drive unit and the tool arrangement to the housing.

At the outer contour of the drive elements, a number N of first support devices are arranged and at the inner contour of the outer housing a number N of second support devices is arranged. Thereby, the first support device cooperates with one second support device respectively such that the outer contour in the inner contour are at a predetermined minimum spacing from one another at every location with the exception of the first and second support devices. Furthermore, one first support device respectively preferably cooperates with one second support device such that the arrangement has a main effective direction.

The number N particularly derives from the design of the first and second support devices. A further influence on the number N of the support devices is in the geometric design of the outer contour of the electric drive unit and tool arrangement as well as in the geometric design of the outer housing. Preferably, the number N is a multitude of two and thus at least two. In that way, to arrangements of the first and second support devices respectively can cooperate in order to facilitate the transmission of supporting forces preferably in all spatial directions. It can however be advantageous to provide an additional arrangement of first and second support devices for transmission of supporting forces within an additional support device, wherein the number N then can also be an uneven number. Preferably, the number N however is as small as possible in order to widely avoid the transmission of sound, heat and vibrations from the electric drive units or the tool arrangement to the housing via the support devices.

The first and second support devices, furthermore, our preferably arranged beyond the gripping region at the outer housing. Thereby, at the gripping region, the inner contour is arranged at a minimum spacing from the outer contour of the drive elements of the machine tool, and can preferably move with respect to the outer contour according to the elasticity of the outer housing in this region, out of which results a certain mechanical decoupling of the gripping region from the drive elements additionally. This also contributes to improved handling comfort of the machine tool, In a preferred embodiment, a boundary area is arranged at the front end of the outer housing, which is preferably formed into the direction of the tool unit, yet at the same time keeps a minimum spacing between the outer housing and the outer contour of the tool arrangement. The boundary area is formed such that it preferably serves as well as a protective screen as as a safety device preventing a penetration of objects from the side of the tool arrangement. Such objects could result in a deterioration of functionability of the machine tool and particularly in a transmission of vibration, sound or heat from the drive elements to the outer housing.

In a further improved embodiment at least one power transmission element is arranged respectively between a first support device and a second support device, wherein the power transmission element transmits the supporting forces between a first and a second support device and at the same time keeps the minimum spacing between the outer contour and the inner contour. By the arrangement of such power transmission element, particularly movement transmitted between the first and the second support device, as particularly those all vibration, are damped. Thereby, particularly the transmission of higher frequent oscillation as sound or vibration is interrupted, A power transmission element adequate for this purpose is elastically deformable on the one hand, but also opposes to deformation by an inner frictional resistance resulting in the damping. In connection with an adequate design of the first and second support devices, the supporting forces between the first and the second support devices are preferably transmitted predominantly by frictional connection via the power transmission elements arranged in between.

In a preferred embodiment of the handheld machine tool the power transmission element arranged between the first and the second support device is charged with an initial tension in a built in condition. Preferably, such an initial tension applies particularly in each power transmission designated direction. An adequate initial tension of the power transmission element particularly amounts to between 20% and 40%, preferably 35%.

Thereby, it can be desirable, that the frictional connection and thereby also the damping effect is unequal for different spatial directions. Preferably, for the formation of such a power transmission, the first and second support device having a power transmission element arranged in between that is geometrically formed such that at different initial tension of a power transmission element consisting of a homogenous material is obtained in different spatial directions. Such an effect can also be obtained by using a power transmission element having different material properties, different thickness or shape. Sections, from which an in inhomogenous tension state within the power transmission element results in connection with the applied initial tension. Particularly, the power transmission element, in order to achieve an inhomogenous tension state, can be configured in several parts or exemplarily comprise recesses, in which material from a neighboring section can expand in a prestressed condition in order to relieve this section or in order to reduce the initial tension in the recessed section itself.

As a material for an adequate power transmission element, particularly a cellular polyurethane elastomer can be used, having a density of particularly between 0.35 and 0.65 $kg/dm^3$ and preferably 0.4 $kg/dm^3$. Such a material is adapted for transmitting supporting forces as the guiding forces from the user to the tool machine or the processing forces from the tool machine to the user and at the same time improve handling comfort, particularly in connection with an adequate initial tension.

In a preferred embodiment of the handheld machine tool, a first support device is formed essentially concave at the support area and a second support device is formed essentially convex at the support area. In the same way the first support device could be performed essentially convex in the support area and a second support device could be formed essentially concave in the support area. Here, it is essential, that the support area of the support device engages geometrically within the support area of the other support device. Thereby, also forces, which apply angular or orthogonal to the engagement direction, can be supported, wherein the engagement directions preferably corresponds to the direction of the forces that are predominantly supported.

The support areas preferably have a spatial form matching to one another, wherein the support area formed concave is preferably formed geometrically bigger depending on the power transmission element—in case a power transmission element is used—, in order to ensure good power transmission and particularly to keep the desired initial tension of the power transmission element. Adequate forms for the geometry of the support areas are particularly rotationally symmetric basic bodies tapering on one side as spherical segments (calottes), truncated cones, sections of ellipsoid bodies or the like. An especially good ratio between the geometric dimensions of the support devices and the forces transmissible thereby is achievable, if a first support device is hollow calotte-formed in its support area and a second support device is configured calotte-formed.

A power transmission element arranged between a first and a second support device can have a shape adapted to a later built-in situation already in a non-built in condition. However, it is also possible that a power transmission element in a non-built-in condition is formed flat for example and, through the initial tension, assumes a different shape in a built-in condition. Thereby, a positive influence on the formation of the initial tension within the power transmission element can result.

In a preferred embodiment, the power transmission element is configured flat in a non-built in condition and has a key like form between a first support area hollow calotte-formed and a second support area calotte-formed in a built in prestressed condition. For achieving an advantageous tension condition in such a power transmission element, the power transmission element can preferably be provided with a recess like for example a circle round opening in its central area.

The handheld machine tool has at least a first support device, which is arranged at the tool arrangement or at the electric drive unit. Thereby, the drive elements of the machine tool, as particularly the electric drive unit and the tool arrangement, are preferably configured such that they are supported essentially rigid with respect to each other and with respect to this one first support device. Such an essentially rigid support of the drive devices with respect to each other can be realized particularly by an inner carrier framework. When using only one single first support device, which can be arranged particularly either at the tool arrangement or at the electric drive unit, said support device is configured such that it can transmit forces into all directions in which forces between the drive elements and the outer housing of the tool machine are effective.

Preferably, the handheld machine tool has, however, at least two first support devices, which preferably have a common axis or at least a common main effective direction—particularly for essentially similar and particularly rotationally symmetric design of first and second support device.

It is generally preferred, that the first support device cooperates with the second support device respectively and both form and assembly of first and second support device thereby. Thereby, a number N of effective first support devices at the drive elements is preferably equal to the number N of effective second support devices at the outer housing.

In a preferred embodiment of the handheld machine tool, the axis of the main effective direction of at least one assembly of support devices runs through the axis of rotation of the electric drive unit. Thereby, forces with an effective direction, that lead to a deflection of the machine tool essentially within the plane of the axis of rotation in the respective direction, can be supported by the assembly of support devices. Furthermore, it is preferred, that the main effective direction of an assembly of support devices runs in a plane orthogonal to the axis of rotation of the electric drive unit. Such support devices can predominantly support forces with effective directions that run essentially orthogonal to the axis of rotation of the electric drive unit and thereby also leads to deflection of the machine tool. For supporting such forces, it is particularly preferred, to arrange a pair of assemblies of support devices symmetrically with respect to the axis of rotation such that there common main effective direction runs through the axis of rotation of the electric drive unit. Preferably, their common main effective direction at the same time runs in a plane orthogonal to this axis of rotation.

Furthermore, an assembly of support devices is preferred, wherein the main effective direction of these supports devices is arranged skew with respect to the axis of rotation of the electric drive unit. Thereby, such a skewly arranged assembly of support devices can run with in a plane orthogonal to the direction of the axis of rotation or also in a plane arranged angularly with respect to the axis of rotation. By means of support devices arranged in this way, forces between the outer housing and the drive elements of the machine tool that have an effect essentially rotatory around the axis of rotation, can be supported.

By an according selection of the effective directions of the deployed assemblies of support devices, transmission of supporting forces between the drive elements and the housing of the handheld machine tool can be accordingly adapted, particularly according to the geometric arrangement of the tool holder at the drive shaft, the additional design of the housing, the intended purpose or further factors of influence.

In a preferred embodiment of the handheld machine tool, at least one first support device is arranged in the area of a second end of the electric drive unit. The second end of the electric drive unit, for handheld machine tools, is usually located opposite the tool holder of the machine tool. Thus, in the area of the second end, and especially advantageous support of support forces can be expected because of the leverage effect. Depending on the design of the machine tool and on the forces being effective during its operation, the first support device is preferably arranged in the area of the second end of the electric drive unit such that has a common main effective direction with an operatively connected second support device, wherein the axis of the common main effective direction of this assembly of support devices is preferably arranged within a plane that is orthogonal with respect to the direction of the axis of rotation of the electric drive unit and intersects the axis of rotation or runs skew with respect to it. Thereby it is possible, to arrange the support devices of the handheld machine tool such that the forces being effective with in an area opposing the tool holder can particularly be supported as favorable as possible with respect to short ways of power transmission between the electric drive unit and the housing.

In a further preferred embodiment of the tool machine, at least two assemblies of first and second support device are arranged as far as possible from each other. Thereby, preferably at least one assembly of first and second support device is arranged at the tool arrangement and at least another assembly of first and second support device is arranged at the end of the electric drive unit that is opposing the tool arrangement. By means of the at least one assembly of first and second support device at the tool arrangement, a good guidance of the machine tool by the user is facilitated. The at least one assembly of first and second support device at the end of the electric drive unit that is opposing the tool arrangement facilitates a sufficient connection of the electric drive unit to the outer housing and thereby—in connection with the assembly of first and second support device at the tool arrangement—a sufficient transmission of guiding forces of the user to the driving devices of the tool machine, In a further preferred embodiment of the handheld machine tool, at least a second support device is arranged at the outer housing in front of the gripping region with respect to the working direction. As already referred to, it is preferred that the second support devices are arranged outside of the gripping region at the outer housing, particularly in order to attain a certain additional mechanical decoupling of the gripping region by means of the elasticity of the outer housing. In order to facilitate a guiding of the machine tool by the user that is as good as possible, the gripping region usually is arranged at an area that is close to the tool holder, wherein it is especially preferred that between the tool holder at the tool arrangement and the gripping region at the outer housing—thus in front of the gripping region in processing direction—a good support of the effective forces is effected. Thereby it is preferred to support at least one support device arranged at the tool arrangement at a second tool arrangement at the outer housing, wherein the second support device is arranged in front of the gripping region of the outer housing.

It is also preferred to arrange at least a second support device at the outer housing behind the gripping region in processing direction, particularly in order to support such forces at the housing that particularly effect a deflection of the handheld machine tool around the pivot point arranged in front of or in the area of the gripping region. Depending on the configuration of the drive elements of the machine tool, this second support device particularly cooperates with a first support device which is arranged at the electric drive unit, preferably at its second end.

In a further preferred embodiment, the outer housing is configured from at least two shell components. Thereby, the parting line of at least two shell components of the outer housing preferably runs at least partially within a direction orthogonal to at least one effective axis of at least one, preferably to, assemblies of first and second support devices, such that forces opposing the assembly of the outer housing are supported. Thereby, the at least two shell components of the outer housing are preferably connected to each other positively and/or non-positively, preferably connected to each other by means of a screwed joint, in the area in which at least a second support device is arranged.

Further advantages, features and applications of the present invention result from the description in connection with the figures below.

Figure 2:
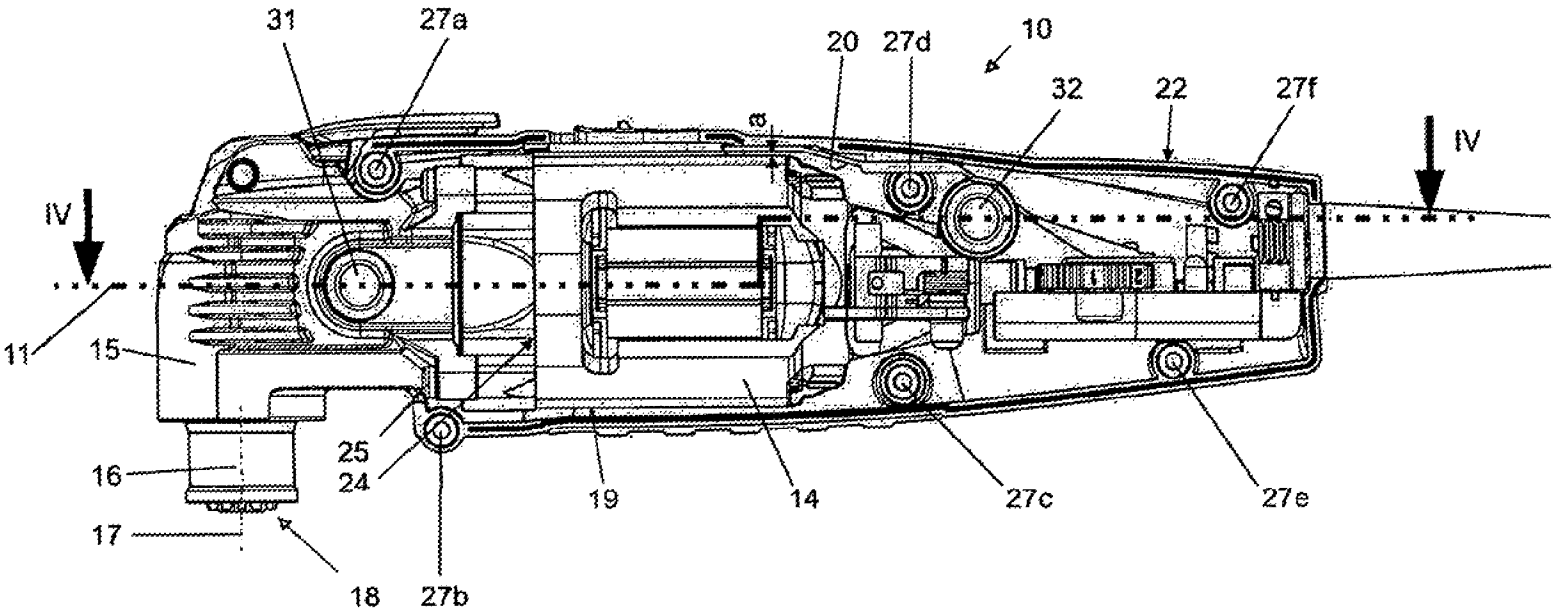
Figure 3:
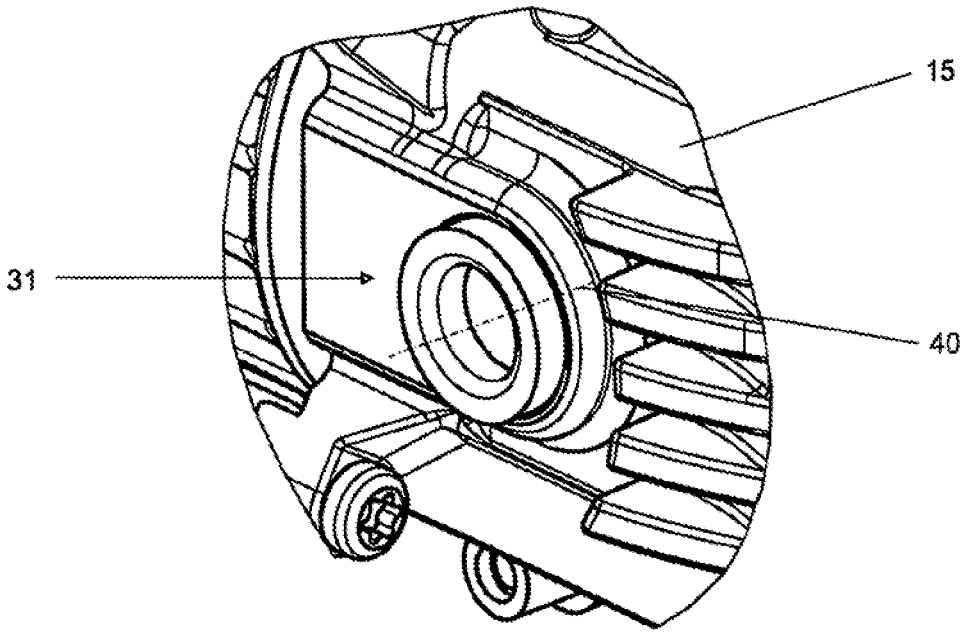
Figure 4:
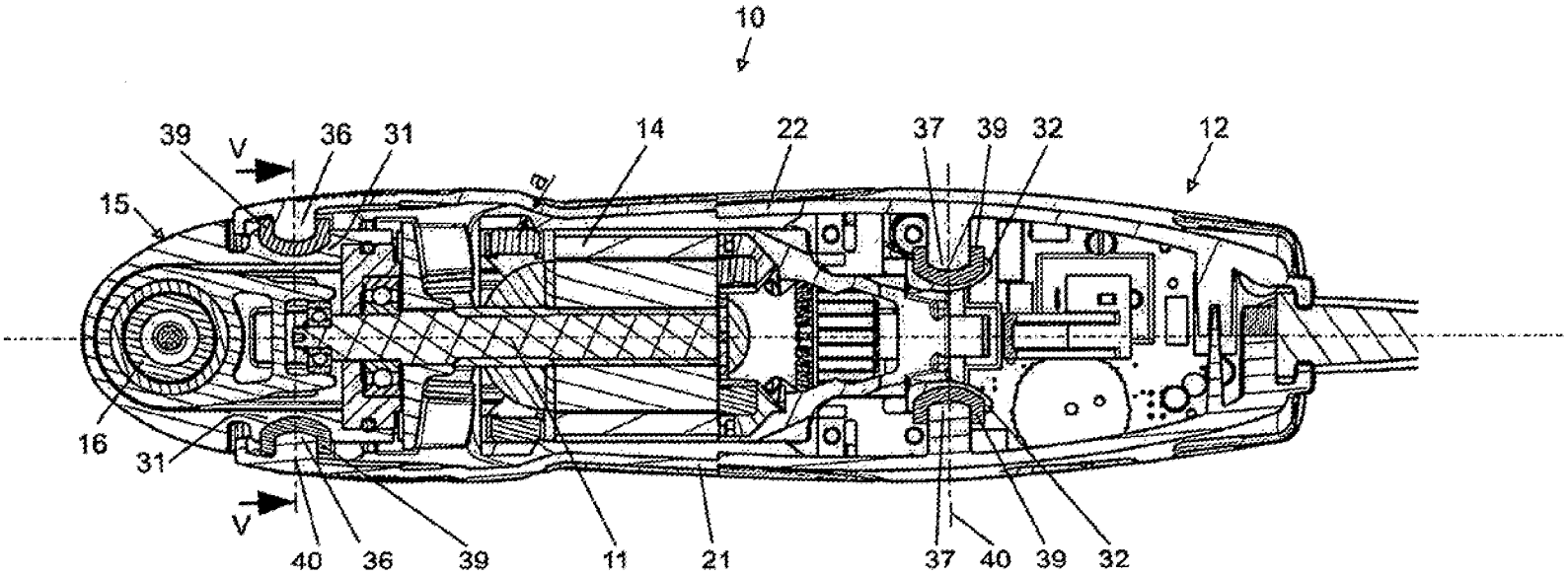
Figure 5:
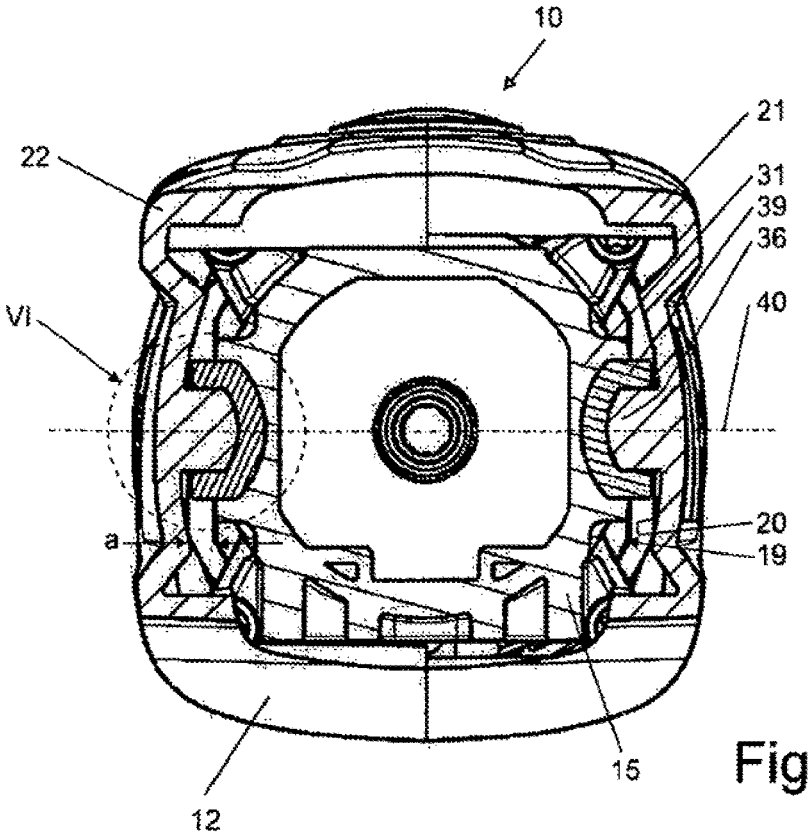
Figure 6:
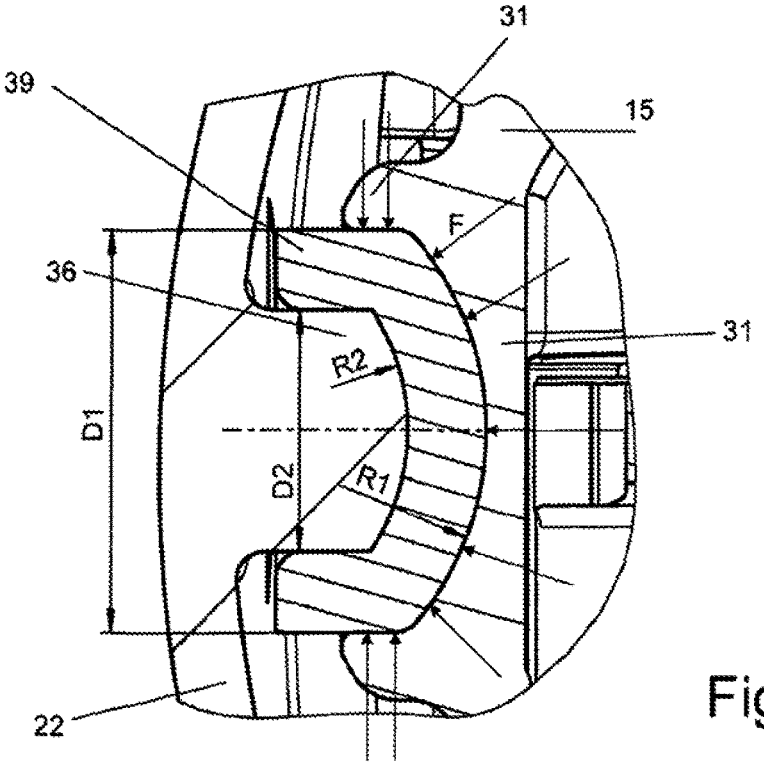

It is depicted in:

FIG. 1: an exemplary handheld machine tool according to the present invention;

FIG. 2: the exemplary handheld machine tool from figure without the front outer housing half shell;

FIG. 3: a three-dimensional representation of a first support device;

FIG. 4: a horizontal section through the tool machine, according to the sectional view IV-IV depicted in FIG. 2;

FIG. 5: a vertical section through an exemplary machine tool, according to the sectional view V-V depicted in FIG. 4; and FIG. 6: an enlarged view of a section through an assembly of first and second support device, according to the sectional view depicted in section VI of FIG. 5.

FIG. 1 depicts an exemplary handheld machine tool According to the present invention, which is carried out as an oscillation machine tool in the exemplary embodiment. The outer housing 12 has a defined inner contour and composes of tool housing halves 21 and 22. Furthermore, the outer housing 12 as a gripping region 13 which is grasped by the user guiding the machine tool. The outer housing 12 surrounds a driving device driving the machine tool as well as an area of the tool arrangement 15 which additionally protrudes from the front of the outer housing 12. The tool arrangement 15 has a driveshaft 16 oscillation driven around the drive axis 17, wherein the drive axis 17 is arranged with an offset of 90°C. downwards with respect to the axis of rotation of the electric drive unit, which coincides with the longitudinal axis of the machine tool in this exemplary embodiment. At the end of driveshaft 16, the tool holder 18 is arranged for accommodation of an eligible processing tool.

FIG. 2 depicts the exemplary handheld machine tool 10 from FIG. 1, wherein the front half shell of the outer housing 12 is not depicted. The drive elements of machine tool 10, particularly the electric drive unit 14 as well as the tool arrangement 15 connected to the electric drive unit 14 by means of screw joints 25, forming a largely rigid unit can be recognized from this view. The axis of rotation 11 of the electric drive unit 14 coincides with it depicted sectional view in its front section.

The electric drive unit 14 and the tool arrangement 15, as far as these are arranged in the area of outer housing 12, have a defined outer contour 19. It is also recognizable from this view, that the boundary of the back half shell 22, which forms the parting line of the outer housing 12 and thereby also part of inner contour 20 of outer housing 12, is arranged at a distance "a" from the drive elements of machine tool 10. The additional devices of the machine tool as the control device, the power supply or the user interface elements, which are predominantly arranged at the rear area of the housing, are mechanically decoupled with respect to electric drive unit 14 in order to avoid the transmission of forces to outer housing 12. Housing connection positions 27*a* to 27*e* arranged at half shell 22, at which the two half shells 21 and 22 are connected to one another by means of screw joints, are also well recognizable.

At the tool arrangement 15, a first support device 31 is arranged at the area that is received within outer housing 12. An additional first support device 32 is arranged in the rear area of electric drive unit 14. At the same position, first support devices 31 and 32 are also arranged at the hidden, opposite side of tool arrangement 15 and electric drive unit 14. Thus, two first support devices 31 respectively are arranged in front of gripping region 13 at the position of the axis of rotation of the electric drive unit 14, wherein the two first support devices 31 surf for transmission of support forces from tool arrangement 15 to outer housing 12. Behind gripping region 13, thus, two first support devices 32 are arranged at the side of electric drive unit 14 opposing tool arrangement 15 at a distance to the axis of rotation 11. So, behind gripping region 13, two first support devices 32 are arranged respectively at a distance to axis of rotation 11 of electric drive unit 14, wherein the two first support devices serve for transmission of support forces from the electric drive unit 14 to outer housing 12. By being arranged orthogonal to axis of rotation 11 and its offset arrangement with respect to the axis of rotation 11, the two first support devices 32 are adapted for supporting towards being effective around axis of rotation 11 with respect to outer housing 12.

FIG. 3 depicts a three-dimensional view of a first support device 31 at tool arrangement 15, wherein the geometry of first support device 31 is essentially equal to the geometry of the first support device 32 arranged at the electric drive unit 14. First support device 31 is formed in the form of a rotationally symmetric deepening strengthened to the outside, which has a hollow calotte form, i.e. the form of a hollow sphere section. By this form, support device 31 is adapted for transmitting forces within a wide variety of effective directions (compared FIG. 6). In FIG. 3, the rotational axis of the geometry of support device 31 is marked, which essentially corresponds to main effective direction 40 of the forces supportable by support device 31.

FIG. 4 depicts a horizontal sectional view through the machine tool running the section depicted in FIG. 2. The section plane is thereby arranged such that it runs through the first support devices 31 and 32 as well as through the axis of rotation 11 of electric drive unit 14 at the front region. At both housing halves 21 and 22, second support devices 36 and 37 are arranged, which cooperate with the first support devices 31 and 32 in order to keep the outer contour and the inner contour at a spacing a from one another, which corresponds to the minimum spacing. In the exemplary embodiment of the machine tool depicted in FIG. 4, the first support devices 31 and 32 and the second support devices 36 and 37 are formed for a corporation with a power transmission element 39 arranged in between, which is charged with an initial tension during assembly of the two housing halves 21 and 22, As can be seen from FIG. 2, connection positions 27*a* to 27*d* are positioned at the regions of assemblies of first and second support devices 31, 32 and 36, 37 in order to achieve a charge of an adequate initial tension when using a power transmission element 39. It is well recognizable from FIG. 4, that the main effective direction 40 of both pairs of assemblies of first and second support devices 31, 32 and 36, 37 are arranged within a plane orthogonal to the longitudinal axis of the machine tool and thereby also to the axis of rotation 11 of the electric drive unit 14.

FIG. 5 shows a vertical section orthogonal to the axis of rotation of the electric drive unit 14, wherein the section follows cutting line V-V pictured in FIG. 4. The two housing halves 21 and 22 of the outer housing 12 are only cover thereby in a verticality middle area of the sectional plane. Also in this figure, the spacing a between outer contour 19 at machine tool 15 and inner contour 20 of outer housing 12 can be well recognized. Main effective direction 40 of both assemblies of first and second support devices 31 and 36 runs through the axis of rotation of the electric drive unit 14. The composition and way of effect of the assemblies of first and second support device 31 and 36 is described in more detail in connection with FIG. 6 showing an enlarged view of detail VI.

FIG. 6 shows an enlarged view of a section through an assembly of first and second support device 31 and 36 having a power transmission element 39 arranged in between. As has already been described, first support device 31 formed in the form of the rotationally symmetric deepening having the form of a hollow calotte in its end region. Second support device 36 is formed in the form of a rotationally symmetric pin, formed in the form of a calotte accordingly. Thereby, diameters D1 and D2 of deepening and pin as well as radiuses R1 and R2 of the sections of the deepening and the pin engaging therein hollow calotte-farmed and calotte-formed; are adapted to each other in connection with the measures and material properties of the power transmission element 39 arranged in between such that power transmission element 39 in an assembled condition, i.e. for half shell halves 21, 22 of outer housing 12 fixedly connected to each other in possibly every direction in which the support of forces F shall take place, has the initial tension desired respectively. Thus, it can be achieved that forces—at least up to a certain dimension—are transmitted by frictional connection in power transmission element 39 without the respective first and second support devices "block", i.e. without a positive connection between support devices 31 and 36 being formed. The field of effective directions of forces F, which can be supported by the assembly of first and second support device 31 and 36 having a power transmission element 39 arranged in between being displayed in FIG. 6, is depicted by means of arrows "F" in this view. Adequate sizes of diameter D1 and of radius R1 of first support device 31 are D1=15 mm and R1=11 mm, which cooperates with the second support device 36 with a diameter D2=9 mm and a radius R2=8 mm when using a power transmission element 39 having a thickness of 5 mm.

This exemplary embodiment depicted in FIGS. 4 to 6 is used in order to keep the predetermined minimum spacing a between outer contour 19 of electric drive unit 14 and tool arrangement 15 and inner contour 20 of outer housing 12, first and second support devices 31, 32, 36, 37 between which a power transmission element 39 is arranged. In the same way, the first support devices 31, 32 of FIGS. 1 to 3 can cooperate with accordingly formed second support devices 36 and 37 without having a power transmission element 39 arranged between the support devices. For these exemplary embodiments, support forces such as structure borne sound, heat and vibration are transmitted from the drive elements of the machine tool to the outer housing 12 in the same way as in the case of overcoming the inner frictional forces of the deployed power transmission element 39, i.e, when the first and second support devices 31, 32, 36, 37 are "blocking". By means of a hand-held machine tool 10 designed according to the invention, support forces are supported via the first and second support devices 31, 32, 36, 37 opposite outer housing 12, wherein outer housing 12 is decoupled particularly with respect to a structure borne sound, heat and vibration of these devices because of the minimum spacing a of electric drive unit 14 and tool arrangement 15.

The invention claimed is:

1. A handheld oscillation machine tool comprising:

an outer housing which extends along its longitudinal axis and has a gripping region configured for the tool to be gripped and guided by a user's hand;

an electric drive unit which is accommodated in the outer housing and which rotationally drives a driveshaft of the machine tool, wherein the driveshaft has an axis of rotation parallel to the longitudinal axis of the outer housing; and a tool arrangement which is coupled to the electric drive unit and which is arranged at an end region of the outer housing; wherein the outer housing has a defined inner contour;

the electric drive unit and the tool arrangement have a defined outer contour;

the outer contour and the inner contour are at a predetermined minimum spacing from one another;

in order to observe the minimum spacing, support devices with elastically deformable damping elements are provided, including first support devices provided on the outer contour and second support devices provided on the inner contour;

the support devices are arranged in pairs of first and second support devices, with one support device in each pair having a concave circular surface centered on an axis, and the other having a convex circular surface that is centered on the axis and axially opposed to the concave surface;

the concave and convex surface in each pair has a circumferential periphery centered on the respective axis, and further has a rotationally symmetrical spherical contour with a radius reaching from the respective axis to the circumferential periphery;

the damping elements are arranged between the pairs of support devices; and the damping elements are deformed from original flat conditions under forces applied by the support devices, and have concave and convex circular surfaces with rotationally symmetrical spherical contours coaxially adjoining the rotationally symmetrical spherical contours of the opposed concave and convex circular surfaces at the support devices.

2. A handheld oscillation machine tool according to claim 1 wherein the first and second support devices are configured such that supporting forces between the first and second support devices are transmitted predominantly by frictional connection.

3. A handheld machine tool according to claim 1 wherein each damping element is held between the respective pair of support devices under tension that is unequal for different spatial directions.

4. A handheld oscillation machine tool according to claim 2 or 3 wherein a cellular polyurethane elastomer serves as material for the damping elements, the material having a density of between 0.35 and 0.65 kg/dm3.

5. A handheld oscillation machine tool according to claim 1 wherein the pairs of support devices include a pair in which the respective axis intersects the longitudinal axis of the outer housing.

6. A handheld oscillation machine tool according to claim 1 wherein the pairs of support devices include a pair in which the respective axis runs skew with respect to the axis of rotation of the electric drive unit.

7. A handheld oscillation machine tool according to one of claim 5 or 6, wherein the pairs of support devices include a pair in which the common axis runs within a plane orthogonal to the axis of rotation of the electric drive unit.

8. A handheld oscillation machine tool according to claim 1 wherein at least one first support device is arranged at an end of the electric drive unit that is opposed to the tool arrangement.

9. A handheld oscillation machine tool according to claim 1 wherein at least one second support device is arranged at the outer housing in front of the gripping region with respect to the direction of the longitudinal axis.

10. A handheld oscillation machine tool according to claim 1 wherein at least one second support device is arranged at the outer housing behind the gripping region with respect to the direction of the longitudinal axis.

11. A handheld oscillation machine tool according to claim 1 wherein the outer housing comprises at least two shell components.

12. A handheld oscillation machine tool according to claim 11 wherein parting lines of at least two shell components of the outer housing at least partially run in a direction orthogonal to at least one axis of a main effective direction of at least one second support device.

13. A handheld oscillation machine tool according to claim 12 wherein at least two shell components of the outer housing are screwed to one another at a region at which at least one assembly of first and second support device is arranged, wherein the connection is effective in the direction of the axis of the main effective direction.

14. The handheld machine tool according to claim 13, wherein the least two shell components of the outer housing are screwed to one another.

15. The handheld machine tool according to claim 4, wherein the material has a density of 0.4 kg/dm$^3$.

* * * * *